US010881231B1

(12) United States Patent
Morehead

(10) Patent No.: US 10,881,231 B1
(45) Date of Patent: Jan. 5, 2021

(54) FRICTION-REDUCING COMPRESSION STOCKING AID

(71) Applicant: Parker Morehead, Plantation, FL (US)

(72) Inventor: Parker Morehead, Plantation, FL (US)

( * ) Notice: Subject to any disclaimer, the term of this patent is extended or adjusted under 35 U.S.C. 154(b) by 95 days.

(21) Appl. No.: 16/162,801

(22) Filed: Oct. 17, 2018

Related U.S. Application Data

(60) Provisional application No. 62/573,803, filed on Oct. 18, 2017.

(51) Int. Cl.
*A47G 25/90* (2006.01)

(52) U.S. Cl.
CPC ..... *A47G 25/907* (2013.01); *A47G 25/90* (2013.01)

(58) Field of Classification Search
CPC .... A47G 25/907; A47G 25/90; A47G 25/905; A47G 25/908
USPC ..... D2/641
See application file for complete search history.

(56) References Cited

U.S. PATENT DOCUMENTS

| | | | | | |
|---|---|---|---|---|---|
| 397,752 | A * | 2/1889 | Ready | | |
| 4,066,194 | A | 1/1978 | Leland | | |
| 4,260,083 | A * | 4/1981 | Aslin | A47G 25/905 | 223/111 |
| D275,239 | S * | 8/1984 | Raso | D2/641 | |
| D302,353 | S * | 7/1989 | Lichter | D2/641 | |
| 5,356,057 | A * | 10/1994 | Vossen | A47G 25/907 | 223/111 |
| 5,673,826 | A | 10/1997 | Stolk | | |
| 5,799,844 | A | 9/1998 | James | | |
| 5,826,761 | A | 10/1998 | Basaj | | |
| 6,032,839 | A * | 3/2000 | Joosten | A47G 25/907 | 223/111 |
| 6,234,370 | B1 * | 5/2001 | Kummerle | A47G 25/905 | 223/111 |
| 7,493,707 | B2 | 2/2009 | Benham | | |
| 8,418,896 | B1 * | 4/2013 | Higa | A47G 25/905 | 223/111 |
| 9,295,353 | B2 * | 3/2016 | Joosten | A47G 25/907 | |
| 2004/0178234 | A1 | 9/2004 | Sawlewicz | | |
| 2007/0119882 | A1 | 5/2007 | Scott | | |
| 2010/0089954 | A1 | 4/2010 | Rondeau et al. | | |
| 2010/0121245 | A1 * | 5/2010 | Marino | A47G 25/907 | 602/75 |
| 2015/0190007 | A1 | 7/2015 | Levelle | | |

* cited by examiner

*Primary Examiner* — Ismael Izaguirre
(74) *Attorney, Agent, or Firm* — John Rizvi; John Rizvi, P.A.—The Patent Professor

(57) ABSTRACT

A friction-reducing compression stocking aid which facilitates placement of a compression stocking on a wearer's foot by reducing friction between the stocking and the foot includes a generally elongated stocking aid body sized and shaped to accommodate a foot of a wearer. A foot opening may be provided in a rear end of the stocking aid body. The foot opening may be sized and configured to receive the foot of the wearer. A pull tab or other protruding portion may extend forwardly from the stocking aid body to facilitate removal of the compression stocking aid from the foot of the wearer after use.

14 Claims, 7 Drawing Sheets

FRICTION-REDUCING COMPRESSION STOCKING AID

CROSS-REFERENCE TO RELATED APPLICATIONS

This application claims the benefit of U.S. Provisional Patent Application Ser. No. 62/573,803, filed on Oct. 18, 2017, which is incorporated herein in its entirety.

FIELD OF THE INVENTION

The present invention relates generally to compression stockings for foot patients, and more particularly, to a friction-reducing compression stocking aid which facilitates ease in placement of a compression stocking on a wearer's foot by reducing friction between the stocking and the foot as the stocking is fitted over the foot.

BACKGROUND OF THE INVENTION

A compression stocking is a specialized item of footwear which helps in the prevention of venous disorders such as edema, phlebitis and thrombosis in the leg of a wearer. Compression stockings often include an elastic material which compresses the leg quite notably. The compressive force which is applied by the stocking is configured to reduce the diameter of distended veins and increase blood flow in the veins of the leg. Use of compression stockings may be effective in relieving an aching leg in the wearer. The stockings may be graduated as to facilitate movement of fluid toward the heart to compensate for poor circulation in the legs to which the stockings are applied.

Because they are strongly elastic, compression stockings typically render the stockings difficult to deploy in place over the foot and on the leg. In practice, placement of a compression stocking on the leg of a wearer may require as much time as 30 minutes per leg and may require a substantial pulling effort to ensure that the sock is extended around the heel of the foot.

Placement of the stockings may be compounded by a wearer's typical lack of strength or flexibility which may result from a decline in the general health and physical condition of the wearer. Some patients may have increased difficulty donning compression stockings due to a recent injury or surgery.

Donning a compression stocking over the foot can be particularly cumbersome, as the foot has an irregular shape, with the heel protruding outwardly from the foot and providing a significant obstacle to the upwardly moving compression stocking. In addition, the fact that the foot forms an angle with the leg further increases the difficulty of passing a tight compression stocking over the foot and onto the leg.

Accordingly, there is an established need for a solution to at least one of the aforementioned problems. For example, there remains a need for a system allowing to reduce the friction between a compression stocking and a foot when donning a compression stocking over a foot and onto a leg of a wearer.

SUMMARY OF THE INVENTION

The present invention is directed to a friction-reducing compression stocking aid which facilitates ease in placement of a compression stocking on a wearer's foot by reducing friction between the stocking and the foot. The friction-reducing compression stocking aid may include a generally elongated stocking aid body which is sized and shaped to accommodate a foot of a wearer. The stocking aid body may be fabricated of plastic, cardboard, paper and/or any other flexible or semi-rigid material known by those skilled in the art. The stocking aid body may include a heel opening which accommodates the heel of the wearer. A graspable and pullable protruding portion may extend forwardly from the stocking aid body to facilitate removal of the compression stocking aid from the foot of the wearer after use. The compression stocking aid may reduce friction between the foot of the wearer and a compression stocking as the compression stocking is slipped over the compression stocking aid and deployed in place on the leg of the wearer.

In a first implementation of the invention, a friction-reducing compression stocking aid comprises an elongated stocking aid body configured to fit over and enclose a foot of a wearer. The stocking aid body has a foot opening in a rear end of the stocking aid body. The foot opening allows insertion of a foot of a wearer therethrough into an interior of the stocking aid body and allows for an outward protrusion of a heel of the foot when the foot is inserted into the interior of the stocking aid body.

In a second aspect, the compression stocking aid can further include a protruding portion extending forwardly from the stocking aid body and configured to be manually grasped and pulled forward of the foot to facilitate removal of the compression stocking aid from the foot.

In another aspect, the protruding portion can include a pull tab.

In another aspect, the stocking aid body can be deformable and configured to allow the interior of the stocking aid body to enlarge as the foot is inserted therein.

In another aspect, the stocking aid body can include a lower body panel, a left body panel and a right body panel. The lower body panel is configured to cover a sole of a foot of a wearer. In turn, the left and right body panels extend from opposite sides of the lower body panel and are configured to cover left and right sides and a top side of the foot.

In another aspect, the lower body panel, left body panel and right body panel can join at a front panel junction of the stocking aid body. The protruding portion can extend forwardly from the stocking aid body at the front panel junction.

In another aspect, the left body panel and right body panel can adjustably overlap at top side of the stocking aid body and can be configured to slide relative to one another. The left and right body panels can continue to overlap to vary the size the interior of the stocking aid body as the interior accommodates a foot when the foot is inserted into the interior of the stocking aid body.

In another aspect, the right body panel can extend from the lower body panel along a right panel junction.

In another aspect, the left body panel can extend from the lower body panel along a left panel junction.

In another aspect, the lower body panel, left body panel and right body panel can be integrally formed into a single-piece unit.

In another aspect, the left body panel and right body panel can be separately formed and attached to the lower body panel.

In another aspect, a heel opening can be provided in the stocking aid body adjacent to the foot opening and on a bottom side of the stocking aid body. The heel opening is configured to accommodate a heel of the foot of the wearer and allow the heel to pass through a bottom side of the stocking aid body.

In another aspect, the heel opening can be a notch extending from the rear end of the stocking aid body towards a front end of the stocking aid body.

In another aspect, the stocking aid body can be fabricated of a flexible material.

In another aspect, the flexible material can include at least one of plastic, cardboard and paper.

In another aspect, the flexible material can include a thin, flexible plastic film.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

Figure 1:
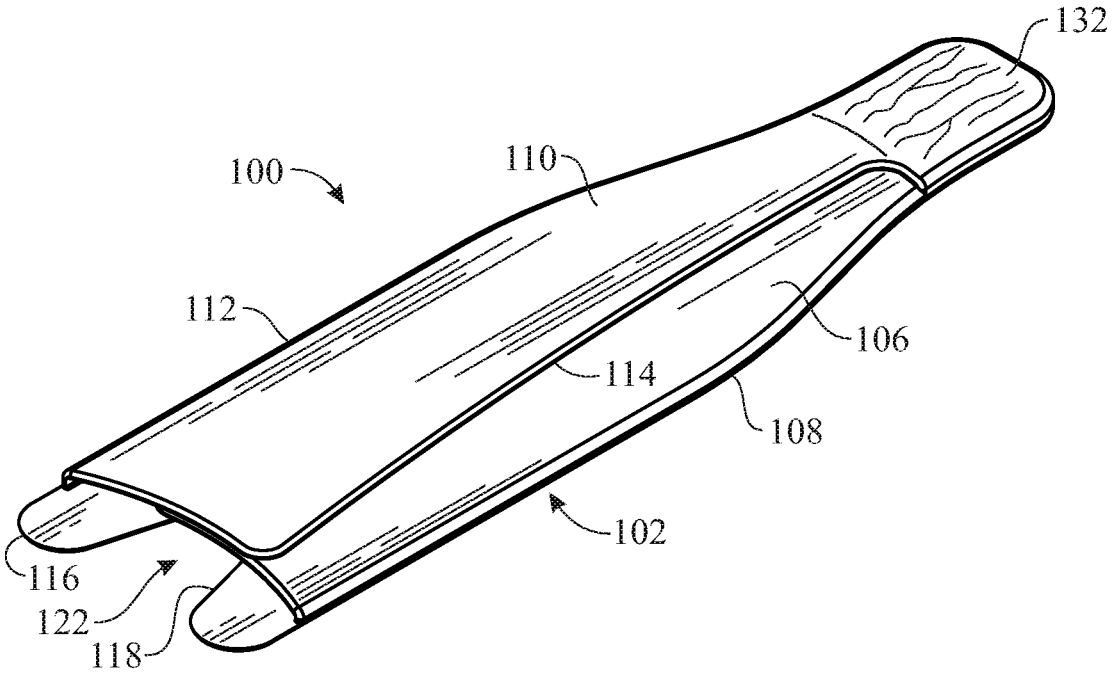
FIG. 1 presents a top rear perspective view of an illustrative embodiment of the compression sock of the present invention.

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed toward a friction-reducing compression stocking aid which facilitates placement of a compression stocking on a wearer's foot by reducing friction between the stocking and the foot as the stocking is fitted onto and over the foot. As will be described hereinafter, the compression stocking aid is also easy to remove from the foot once the compression stocking has been fitted in place onto the foot and/or leg of the wearer.

Referring initially to FIGS. 1-3 and 8, an illustrative embodiment of the friction-reducing compression stocking aid, hereinafter stocking aid, is generally indicated by reference numeral 100. The stocking aid 100 may include a stocking aid body 102. The stocking aid body 102 may be generally elongated and may be suitably sized and configured to accommodate a foot 134 (FIGS. 4 and 5) of a wearer 136 for purposes which will be hereinafter described.

Figure 2:
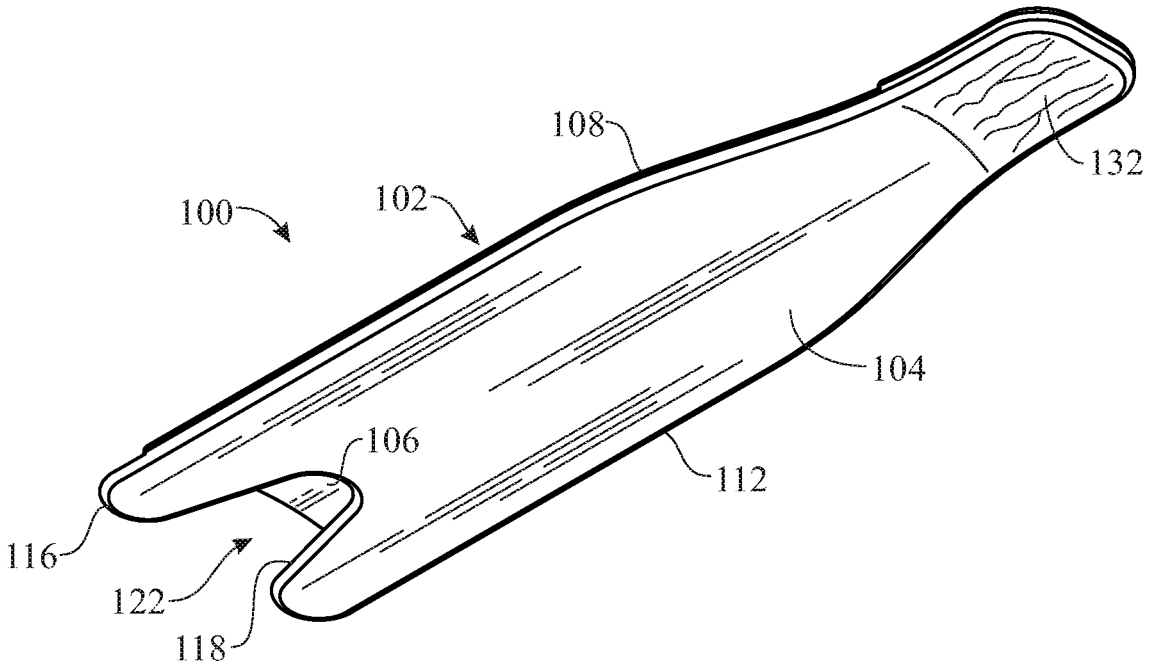
FIG. 2 presents a bottom perspective view of the compression sock of FIG. 1.

The stocking aid body 102 may be fabricated of plastic, cardboard, paper and/or any other flexible, low-friction material known by those skilled in the art. By low-friction it is understood that the material provides a significantly lower friction against a compression aid stocking fabric than the friction offered by human skin against the same compression aid stocking fabric. For example, the stocking aid body 102 may be formed by a thin, flexible plastic film. As shown in FIG. 2, the stocking aid body 102 may include a lower body panel 104. The lower body panel 104 may have a lower body panel rear edge 116. In some embodiments, a heel opening, which can be formed as a notch 118, may extend from the lower body rear panel edge 116 of the lower body panel 104 and towards a front end of the lower body panel 104.

As shown in FIGS. 1 and 2, a right body panel 106 may extend from the lower body panel 104 along a right panel junction 108. The right panel junction 108 may be formed as a seam connecting separately-formed lower and right body panels 104 and 106. In alternative embodiments, the lower and right body panels 104 and 106 may be integrally formed into a single-piece unit (e.g., a continuous plastic or paper sheet) and the right panel junction 108 may be a transition area between the integrally-formed lower and right body panels 104 and 106.

Similarly, a left body panel 110 may extend from the lower body panel 104 along a left panel junction 112. The left panel junction 112 may be formed as a seam connecting separately-formed lower and left body panels 104 and 110. In alternative embodiments, the lower and left body panels 104 and 110 may be integrally formed into a single-piece unit (e.g., a continuous plastic or paper sheet) and the left panel junction 112 may be a transition area between the integrally-formed lower and left body panels 104 and 110.

Figure 8:
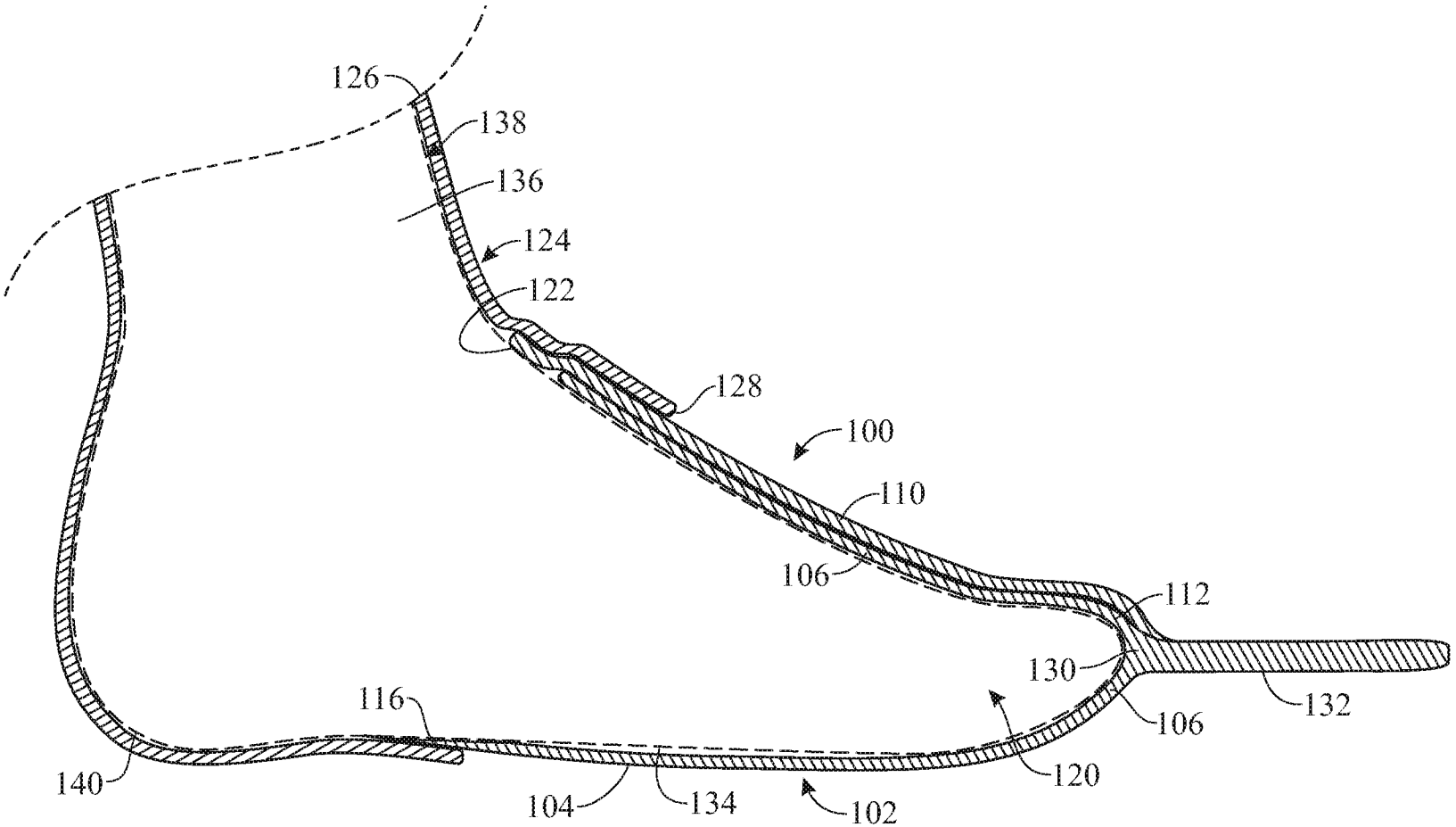
FIG. 8 is a cross-sectional side elevation view of the compression stocking aid in place on the foot of the wearer and the compression stocking in place on the wearer's leg.

As illustrated in FIG. 8, a body interior 120 may be formed within the stocking aid body 102. A foot opening 122 which communicates with the body interior 120 is formed at the rear end of the stocking aid body 102, and more specifically, by and between the lower body panel 104, the right body panel 106 and the left body panel 110.

Figure 3:
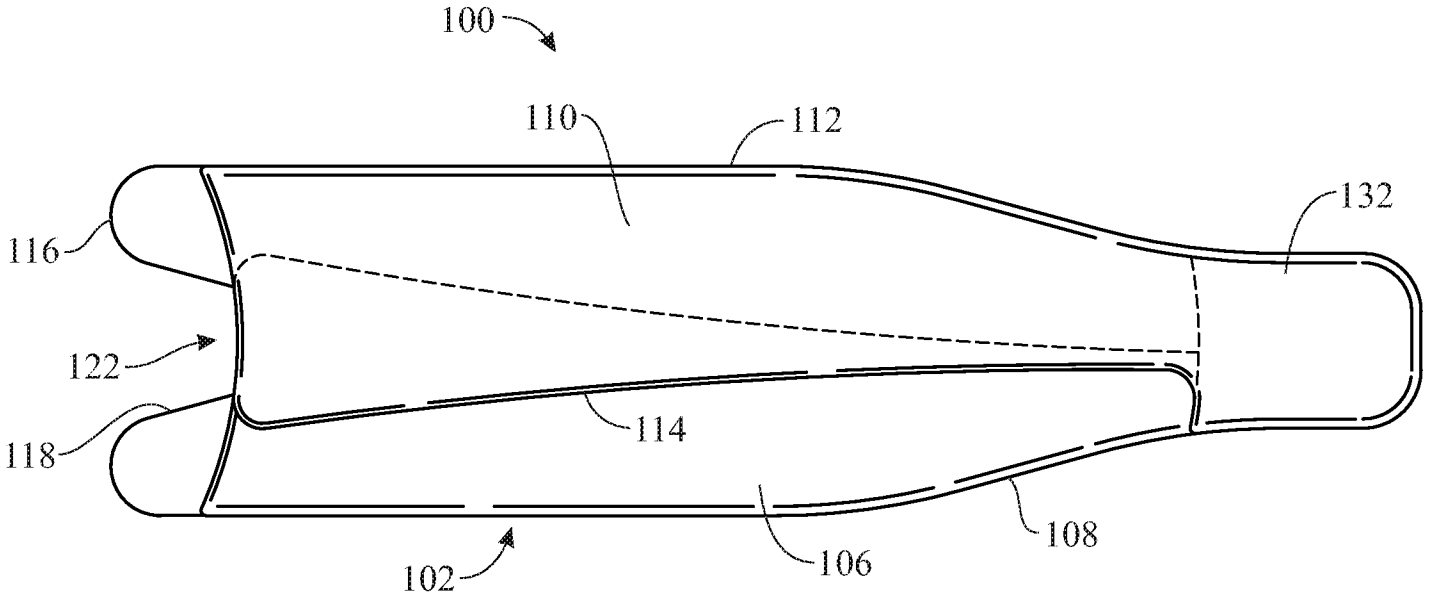
FIG. 3 presents a top plan view of the compression sock of FIG. 1.

As illustrated in FIGS. 1 and 3, the left body panel 110 may extend over the right body panel 106, i.e. overlapping the right body panel 106. The left body panel 110 may have a panel edge 114 which overlies the right body panel 106. Accordingly, the panel edge 114 on the left body panel 110 may be capable of sliding with respect to the right body panel 106 to vary the size or volume of the body interior 120 as it accommodates a foot 134 having a particular size, as will be hereinafter further described, without a gap being formed between the right body panel 106 and left body panel 110 which could expose the foot.

As mentioned heretofore, in some embodiments, the right body panel 106 and the left body panel 110 may be fabricated in one piece with the lower body panel 104. The right panel junction 108 may include a fold line along which the right body panel 106 is pivotally joined or hinged to the lower body panel 104. The left panel junction 112 may include a fold line along which the left body panel 110 is joined to the lower body panel 104. In other embodiments, the lower body panel 104, the right body panel 106 and the left body panel 110 may be fabricated separately. The right body panel 106 may be joined to the lower body panel 104 along the right panel junction 108 and the left body panel 110 may be joined to the lower body panel 104 along the left panel junction 112 using any suitable attachment technique known by those skilled in the art.

As shown in FIGS. 1 and 2, a protruding portion 132 extends frontward from a front end of the stocking aid body 102. In some embodiments, such as the present embodiment, the protruding portion is formed as a generally planar, pull tab. The protruding portion 132 is shaped and sized to allow a person to grasp the protruding portion 132 with one or both hands and pull the protruding portion 132 forward for purposes which will be hereinafter described. As illustrated in FIG. 8, in some embodiments, the lower body panel 104, the right body panel 106 and the left body panel 110 of the stocking aid body 102 may be molded, mechanically attached and/or otherwise attached to each other at a front panel junction 130, and the protruding portion 132 may extend forwardly from the front panel junction 130.

Referring next to FIGS. 4-7, in typical application, the compression stocking aid 100 may be placed on a foot 134 of a wearer 138 to facilitate ease in placement of a compression stocking 124 on the leg 136 of the wearer 138. The compression stocking 124, first shown in FIG. 5, may apply a compressive force which may reduce the diameter of distended veins and increase blood flow in the veins of the wearer's leg 136. Accordingly, use of the compression stocking 124 may be effective in improving circulation and relieving aching in the leg 136 of the wearer 138. The compression stocking 124 may be conventional and typically includes an elastic or stretchable material. The compression stocking 124 may have a leading stocking edge 126 and a trailing stocking edge 128. While a short compression stocking 124 has been depicted in the drawings, alternative compression stockings 124 may be used.

Figure 4:
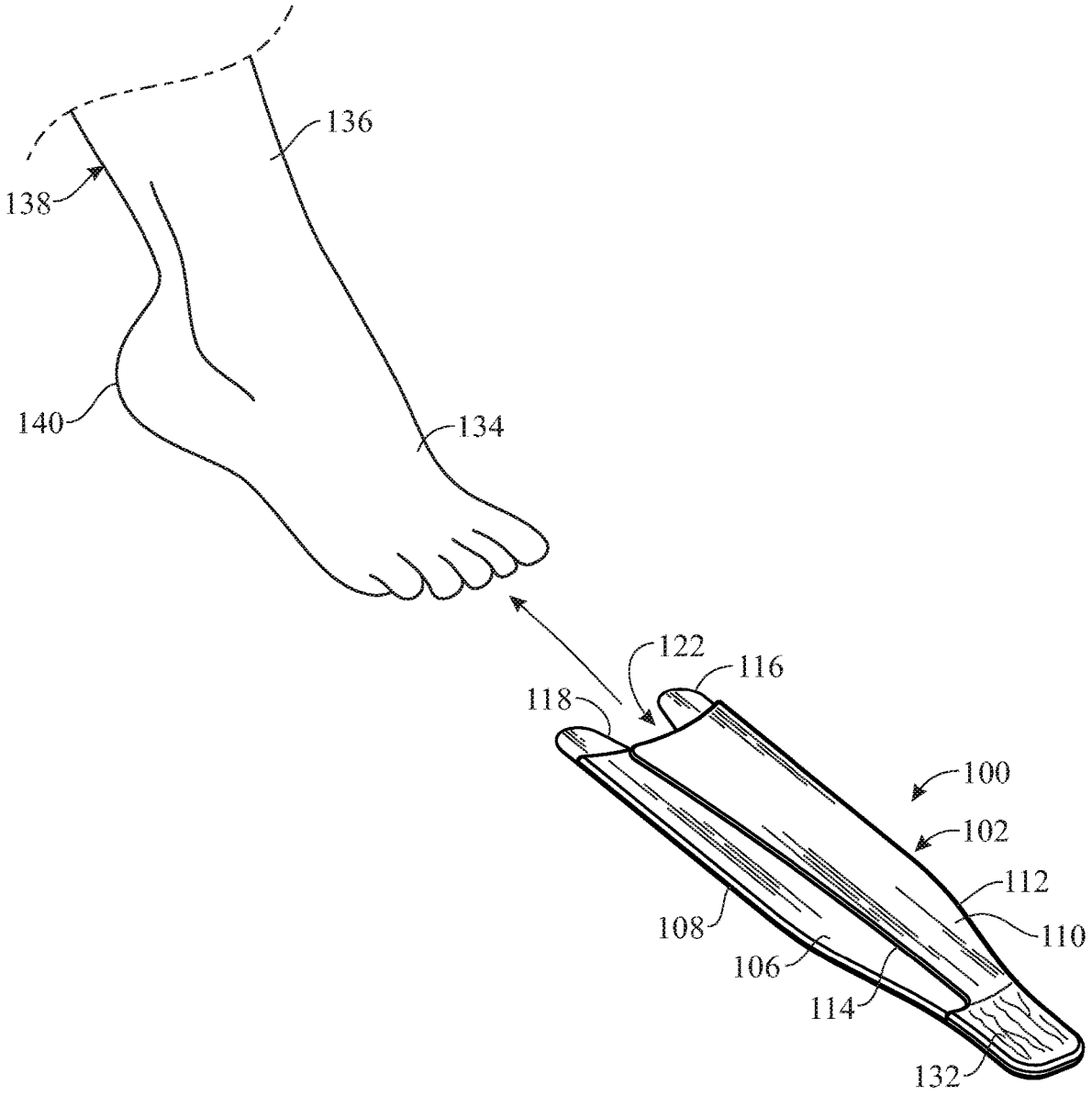
FIG. 4 presents an exploded perspective view illustrating typical placement of the compression stocking aid of FIG. 1 onto the foot of a wearer in typical application of the compression stocking aid.
Figure 5:
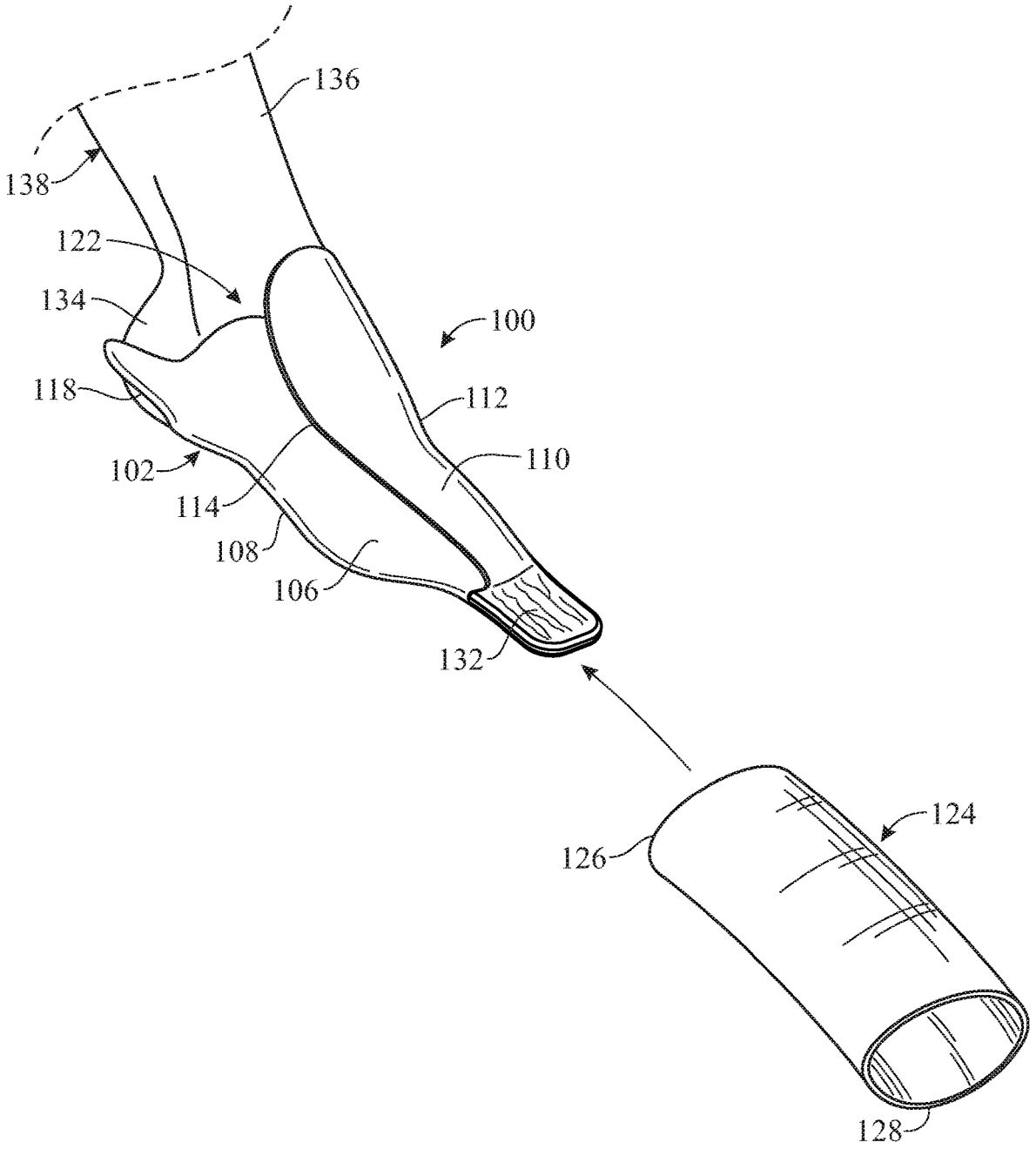
FIG. 5 presents an exploded perspective view illustrating typical positioning of a compression stocking relative to the compression stocking aid on the foot of the wearer preparatory to deployment of the compression stocking on the wearer's leg.

As illustrated in FIG. 4, the compression stocking aid 100 may be placed on the wearer's foot 134 by initially aligning the foot opening 122 in the rear of the stocking aid body 102 with the foot 134. The stocking aid body 102 may then be pulled rearwardly such that the foot 134 inserts through the foot opening 122 and into the body interior 120 (FIG. 8) of the stocking aid body 102 and the heel 140 of the foot 134 protrudes outwardly of the compression stocking aid body 102, as illustrated in FIG. 5. Accordingly, the pull tab or protruding portion 132 may extend forwardly from the covered foot 134 of the wearer 138. The body interior 120 (FIG. 8) of the stocking aid body 102 may enlarge as the panel edge 114 of the left body panel 110 slides with respect to the right body panel 106 to accommodate a wearer's foot 134 having a particular size. When the compression stocking aid 100 is deployed in place on the wearer's foot 134, as illustrated in FIG. 5, the heel notch 118 in the lower body panel rear edge 116 of the lower body panel 104 of the stocking aid body 102 may accommodate the heel of the wearer's foot 134. Furthermore, in the donned position of FIG. 5, the right and left body panels 106 and 110 continue to overlap at the top of the foot 134.

Figure 6:
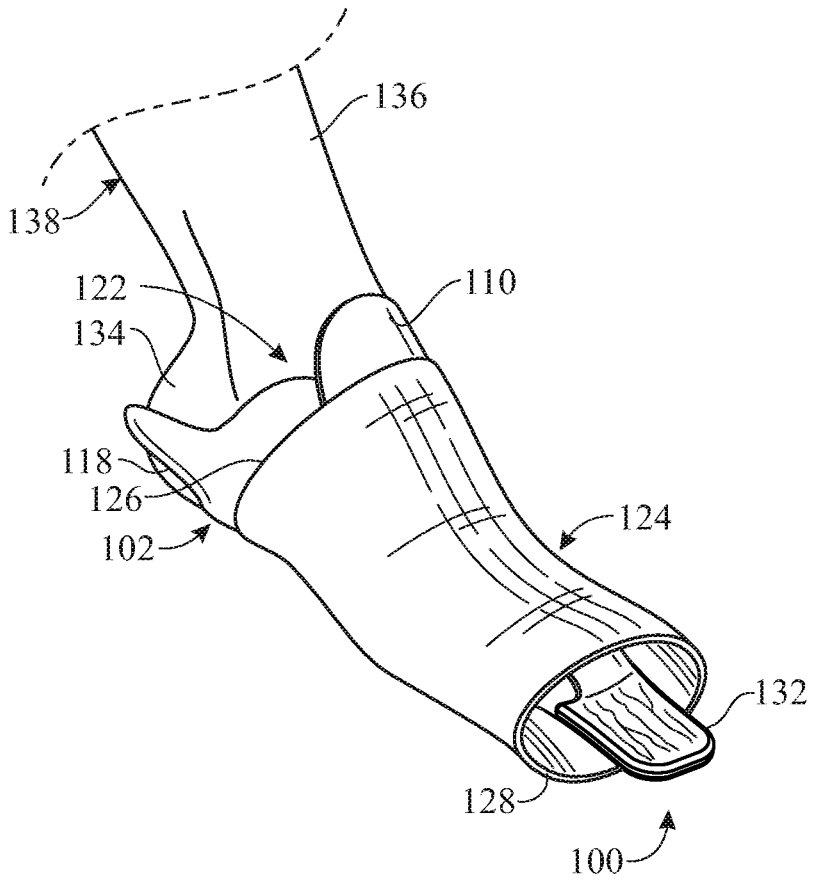
FIG. 6 presents a perspective view of the compression stocking as it slides over the compression stocking aid in deployment of the compression stocking on the wearer's leg.
Figure 7:
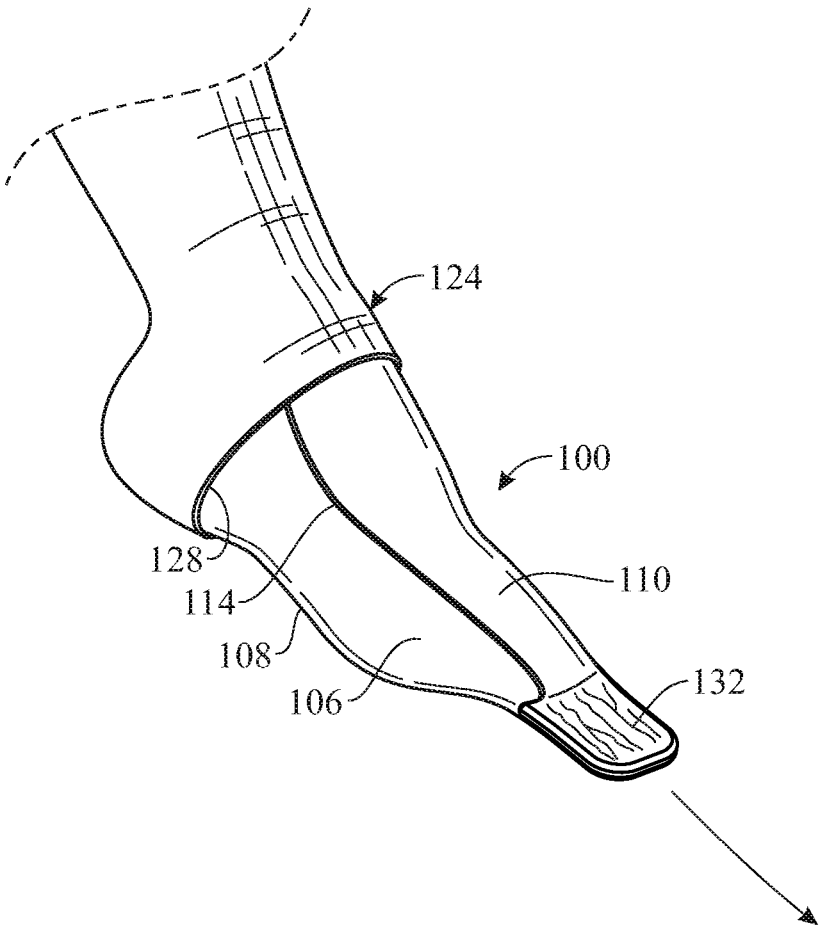
FIG. 7 is a perspective view of the compression stocking deployed in place on the wearer's leg as the compression stocking aid remains in place on the foot of the wearer.

As further illustrated in FIG. 5, the compression stocking 124 may next be deployed in place on the leg 136 of the wearer 138 typically as follows. The compression stocking 124 may be pulled over the stocking aid body 102 of the compression stocking aid 100 with the leading stocking edge 126 leading the trailing edge 128 of the stocking aid body 102. As illustrated in FIG. 6, the compression stocking 124 may continue to be pulled over the stocking aid body 102 of the compression stocking aid 100 until the compression stocking 124 is deployed in place on the leg 136 of the wearer 138. When the compression stocking 124 is deployed in place, as illustrated in FIGS. 7 and 8, the trailing stocking edge 128 of the compression stocking 124 may overlap the rear edge of the stocking aid body 102 of the compression stocking aid 100 and also overlap the wearer's heel 140. Though not specifically shown, alternative final placements of the compression stocking 124 relative to the wearer's foot are contemplated. For instance and without limitation, it is common to have the compression stocking 124 substantially cover the entire foot such that the trailing stocking edge 128 of the compression stocking 124 is arranged at the front of the foot and only the wearer's toes are arranged forward of the trailing stocking edge 128.

It will be appreciated by those skilled in the art that as the compression stocking 124 is slid over the stocking aid body 102 of the compression stocking aid 100, as illustrated in FIG. 6, in deployment of the compression stocking 124 on the leg 136, as illustrated in FIG. 7, the stocking aid body 102 provides a substantially friction-free or friction-reduced surface for movement of the compression stocking 124. Such a frictionless effect is enhanced by the fact that the right and left body panels 106 and 110 overlap at the top of the foot 134. Accordingly, the compression stocking aid 100 facilitates ease and reduced effort on the part of the wearer 138 in deploying the compression stocking 124 on the leg 136 of the wearer 138.

After the compression stocking 124 is in place, the compression stocking aid 100 can be removed from the wearer's foot 134 by grasping the pull tab or protruding portion 132 and pulling the stocking aid body 102 forwardly. Accordingly, the stocking aid body 102 slides forwardly off the wearer's foot 134 as the compression stocking 124 remains in place on the wearer's leg 136. The stocking aid body 102 may be pulled forwardly from the wearer's foot 134 through a front opening delimited by the trailing stocking edge 128 in the compression stocking 124. The heel notch 118 in the rear end of the stocking aid body 102 prevents a high friction from forming between the heel 140 and the stocking aid body 102 when pulling out the stocking aid body 102 from in between the foot 134 and the compression stocking 124, and thus contributes to a smooth pulling out of the stocking aid body 102 through the front opening of the compression stocking 124 once the compression stocking 124 is in place.

In some applications, the wearer 138 may dispose of the compression stocking aid 100 after use. Multiple compression stocking aids 100 may be packaged in a single box or other package typically in the same manner as latex gloves, paper towels and other consumables. The compression stocking aid 100 may be applicable to the medical industry or available to the public for individual home use.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A friction-reducing compression stocking aid which facilitates placement of a compression stocking on a wearer's foot by reducing friction between the stocking and the foot, comprising:

an elongated stocking aid body configured to fit over and enclose a foot of a wearer, the stocking aid body comprising a foot opening in a rear end of the stocking aid body, the foot opening configured to allow insertion of a foot of a wearer therethrough into an interior of the stocking aid body and allow for an outward protrusion of a heel of the foot when the foot is inserted into the interior of the stocking aid body, a heel opening is provided in the stocking aid body adjacent to the foot opening and on a bottom side of the stocking aid body and is configured to accommodate the heel of the foot of the wearer and allow the heel to pass through the bottom side of the stocking aid body, wherein the heel opening is a notch extending from the rear end of the stocking aid body towards a front end of the stocking aid body.

2. The compression stocking aid of claim 1, further comprising a protruding portion extending forwardly from the stocking aid body and configured to be manually grasped and pulled forward of the foot to facilitate removal of the compression stocking aid from the foot.

3. The compression stocking aid of claim 2, wherein the protruding portion comprises a pull tab.

4. The compression stocking aid of claim 1, wherein the stocking aid body is deformable and configured to allow the interior of the stocking aid body to enlarge as the foot is inserted therein.

5. The compression stocking aid of claim 1, wherein the stocking aid body comprises a lower body panel, a left body panel and a right body panel, wherein the lower body panel is configured to cover a sole of a foot of a wearer, and further wherein the left and right body panels extend from opposite sides of the lower body panel and are configured to cover left and right sides and a top side of the foot.

6. The compression stocking aid of claim 5, wherein the lower body panel, left body panel and right body panel join at a front panel junction of the stocking aid body, and further wherein a protruding portion extends forwardly from the stocking aid body at the front panel junction and is configured to be manually grasped and pulled forward of the foot to facilitate removal of the compression stocking aid from the foot.

7. The compression stocking aid of claim 5, wherein the left body panel and right body panel adjustably overlap at top side of the stocking aid body and are configured to slide relative to one another and continue to overlap to vary the size the interior of the stocking aid body as said interior accommodates a foot when said foot is inserted into the interior of the stocking aid body.

8. The compression stocking aid of claim 5, wherein the right body panel extends from the lower body panel along a right panel junction.

9. The compression stocking aid of claim 5, wherein the left body panel extends from the lower body panel along a left panel junction.

10. The compression stocking aid of claim 5, wherein the low y panel, left body panel and right body panel are integrally formed into a single-piece unit.

11. The compression stocking aid of claim 5, wherein the left body panel and right body panel are separately formed and attached to the lower body panel.

12. The compression stocking aid of claim 1, wherein the stocking aid body is fabricated of a flexible material.

13. The compression stocking aid of claim 12, wherein the flexible material comprises at least one of plastic, cardboard and paper.

14. The compression stocking aid of claim 13, wherein the flexible material comprises a thin, flexible plastic film.

* * * * *